US009204779B2

(12) United States Patent
Haltmayer et al.

(10) Patent No.: US 9,204,779 B2
(45) Date of Patent: Dec. 8, 2015

(54) WATER-BEARING DOMESTIC APPLIANCE, IN PARTICULAR DOMESTIC DISH WASHER

(71) Applicant: BSH Bosch und Siemens Hausgeräte GmbH, Munich (DE)

(72) Inventors: Werner Haltmayer, Dinkelsbühl (DE); David Hite, New Bern, NC (US); Peter Martin, Burgheim (DE)

(73) Assignee: BSH Hausgeraete GmbH, Munich (DE)

( * ) Notice: Subject to any disclaimer, the term of this patent is extended or adjusted under 35 U.S.C. 154(b) by 373 days.

(21) Appl. No.: 13/798,238

(22) Filed: Mar. 13, 2013

(65) Prior Publication Data

US 2014/0261583 A1 Sep. 18, 2014

(51) Int. Cl.

| | |
|---|---|
| ***A47L 15/42*** | (2006.01) |
| ***D06F 39/08*** | (2006.01) |
| ***D06F 39/12*** | (2006.01) |

(52) U.S. Cl.

CPC ..... *A47L 15/4217* (2013.01); *D06F 39/088* (2013.01); *D06F 39/12* (2013.01)

(58) Field of Classification Search

None

See application file for complete search history.

(56) References Cited

U.S. PATENT DOCUMENTS 5,572,776 A * 11/1996 Murphy et al. ..... 24/543
2009/0277485 A1* 11/2009 Haltmayer et al. ..... 134/56 D

FOREIGN PATENT DOCUMENTS

DE 19950818 A1 * 4/2001
EP 0915197 B1 10/2003
WO WO 2012140595 A2 * 10/2012

* cited by examiner

*Primary Examiner* — Michael Barr
*Assistant Examiner* — Cristi Tate-Sims
(74) *Attorney, Agent, or Firm* — James E. Howard; Andre Pallapies

(57) ABSTRACT

A water-bearing domestic appliance, in particular a home dish washer or a home laundry machine, includes a supply hose for the supply with fresh water from a domestic water pipe arranged outside of the water-bearing domestic appliance into the water-bearing domestic appliance, wherein the supply hose has a connection device on its hose terminus for detachable connection with the domestic water pipe, and wherein the supply hose is guided through a wall in particular a back wall of the water-bearing domestic appliance into the interior of the water-bearing domestic appliance. At least in the region of the connection device, at least some regions of the supply hose are permanently received in at least one holding element, in particular at least partially form fittingly, wherein the at least one holding element can be arranged on the wall, in particular on the back wall of the water-bearing domestic appliance.

24 Claims, 3 Drawing Sheets

WATER-BEARING DOMESTIC APPLIANCE, IN PARTICULAR DOMESTIC DISH WASHER

BACKGROUND OF THE INVENTION

The invention relates to a water-bearing domestic appliance in particular a domestic dish washer or a laundry machine with a supply hose for the supply of fresh water from a water pipe arranged outside of the water-bearing domestic appliance into the water-bearing domestic appliance, wherein the supply hose has at its hose beginning a connection device for the detachable connection with a domestic water pipe, and wherein the supply hose is guided through a wall, in particular a back wall into the inside of the water-bearing domestic appliance.

Such a water-bearing domestic appliance in the form of a house hold laundry machine is for example known from DE 199 50 818 A1. The disclosed water-bearing appliance includes a supply hose with a connection armature including a valve housing and a union nut which is held rotatably and with a distance to the valve housing on a pipe socket. The water-bearing domestic appliance further includes a back wall through which the supply hose is guided into the inside of the water-bearing domestic appliance. In order to fix the supply hose for the purpose of packaging and/or for transport, the back wall has a structure whose outer shape is at least partially and at least approximately adjusted to the intermediate space between the valve housing and the union nut. The supply hose can thus be folded in by means of a single manipulation when the installation of the water-bearing domestic appliance is complete so that the pipe socket in the intermediate space between the valve housing and the union nut is surrounded by the structure. With this, the supply hose is sufficiently fixed for the purpose of packaging and/or transport.

Further, a water-bearing domestic appliance such as a laundry machine, a laundry dryer or a dish washer is known from DE 197 48 703 A1 which is provided with an electric power supply cord and with at least one supply hose which serves for conducting fluid, which power supply cord and which supply hose are fixable during transport of the water-bearing domestic appliance at the back wall of the domestic appliance by means of a holding element. The holding element is configured as a U-shaped elbow which can be form fittingly coupled with the free end of the supply hose which elbow is provided on both of its U-legs with clip-like holding openings which are adjusted to the diameter of the supply hose, and has a fastening device for detachable fastening on the back wall of the water-bearing domestic appliance.

In praxis, installation of a water-bearing domestic appliance equipped with such a holding element into an installation niche of a furniture wall often poses a recurring appliance-related problem. This problem is always that the domestic appliance cannot be fully inserted into the installation niche and thus is not fully flush with the front side of the furniture wall. The sole reason for this appliance-related problem is the presence of the holding element on the back wall or the water-bearing domestic appliance, i.e., that the holding means is not removed from the back side of the domestic appliance. In many cases, the person charged with installing the domestic appliance is capable of recognizing and solving this appliance-related installation problem. In some cases however, customer service is requested and charged with the installation of the domestic appliance as a result of to the occurring installation problem. Requesting customer service causes unnecessary costs and the work of the customer service is usually limited exclusively to the removal of the holding device from the backside of the domestic appliance.

BRIEF SUMMARY OF THE INVENTION

Thus, it is an object of the invention to refine a water-bearing domestic appliance known according to the preamble of the independent claim, in particular a domestic dish washer or a domestic laundry machine so that on one hand the described possible appliance-related installation problem is effectively prevented, preferably its possible occurrence excluded altogether, and on the other hand the positioning of the connection device of the supply hose is ensured at least during installation of the water-bearing domestic appliance in an accurate and reproducible manner for testing purposes.

According to the invention, this object is solved in that at least some regions of the supply hose are permanently received at least in the region of its connection device in at least one holding element, in particular at least partially in a form fitting manner, and in that at least one holding element can in turn be arranged on the wall, in particular the back wall of the water-bearing domestic appliance.

The invention provides a water-bearing domestic appliance, in particular a home dish washer or a home laundry machine which can be installed in an installation niche of a furniture wall without device inherent problems. When the supply hose is removed from the wall in particular the back wall of the water-bearing domestic appliance the holding element which is permanently and in particular at least in regions thereof form fittingly arranged on the connection device is also removed. This effectively prevents an insertion of the domestic appliance into an installation niche without prior removal of the holding element from the wall in particular the back wall of the water-bearing domestic appliance. With this even a lay person can install the domestic appliance according to the invention without problems and without repeated insertion in the installation niche of the furniture wall. Customer service does not have to be called.

Further, the capability to arrange the holding element on the wall in particular the back wall of the water-bearing domestic appliance ensures that the connection device of the supply hose can be accurately and reproducibly positioned. This manner of positionabiltiy creates ideal conditions for an automated and at the same time function verifying first filling of the water-bearing domestic appliance because a filling sensor of a filling system can automatically approach the connection device of the supply hose of the water-bearing domestic appliance from underneath. A manual intervention during the first filling of the water-bearing domestic appliance is no longer required.

The holding element for a permanent and in particular form fitting reception of the at least one connection device includes preferably a body unit with an approximate cylinder shape and a plurality of engagement units, which are arranged on at least one axial end of the body unit and protrude on one side of the center axis of the body unit in order to thereby at least receive at least regions of the connection device in a form fitting manner. A important advantage of such a holding element is that it can be manufactured easily which however is also reliable in its use.

The body unit of the holding element for the permanent and in particular form fitting reception of at least the connection device is preferably divided into two separate sections which are capable to be detachably interconnected. This allows the Body unit of the holding element to be easily and fast and embracing from two sides arranged on the connection device of the supply hose.

Further, the two separate sections have preferably a first engagement section and a second engagement section which are arranged separate from the separated sections and are capable to be brought in engagement with one another in a non detachable manner. This type of engagement allows improving the quality of the effective engagement significantly. In addition, the effective engagement can be manufactured relatively easily.

In order for the two separated sections of the body unit of the holding element for the permanent and in particular form fitting reception of at least the connection device are interconnected reliably but also with greatest possible flexibility the body unit has preferably a joint unit, preferably a hinge, in particular a film hinge which is arranged on a side which is opposite the first engagement section and the second engagement section relative to the center axis of the body unit.

With regard to a simple and practical construction the two engagement sections are configured as complementary engagement hooks. Such an engagement hook has a simple construction and saves cost in its manufacturing in particular when taking tool costs into account.

Further, the body unit of the holding element for the permanent and in particular form fitting reception of at least the connection device preferably has a window region in a center region in longitudinal direction, which window section extends in circumferential direction of the body unit and which preferably interrupts the hinge in particular the film hinge thus dividing it in two. By means of such a window section, the orientation and position of the connection device can be determined easily and quickly. Such a window section also reduces materials and with this costs.

In order to ensure a secure guidance of at least regions of the supply hose the body unit of the holding element of the permanent and in particular form fitting reception of at least the connection device includes preferably two mushroom-shaped and spaced apart holding pins, which are detachably connectable with the wall, in particular with the back wall of the water-bearing domestic appliance. The mushroom-shaped contour of the two holding pins allows manufacture of a fast and tool less holding, the spacing apart of the two holding pins on the other hand provides a sufficient positional stability for the holding element and with this for the connection device.

The single mushroom-shaped holding pin is preferably divided longitudinally identical in an identical manner and one respective longitudinal half of the single mushroom-shaped holding pin of the holding element is preferably assigned in a materially bonding manner to one of the two engagement sections of the body unit of the holding element.

When the water-bearing domestic appliance is configured as a home dish washer which has a treatment container for receiving dishes to be treated the holding element for the permanent and in particular form fitting reception of at least the connection device receiving back wall of the home dish washer is preferably a basic carrier in particular a plastic floor which carries the treatment container by means of an at least rearward acting guiding arrangement.

Further, the holding element which is arranged on the back wall of the water-bearing domestic appliance is preferably oriented in its holding position so that it guides the supply hose and with this the connection device vertically or approximately vertically and in that the beginning of the hose of the supply hose points downward. This type of positionability creates ideal conditions of an automated and at the same time function testing first filling of the water-bearing domestic appliance via the supply hose because a filling probe of a filling system can approach the connection device of the supply hose of the water-bearing domestic appliance from below.

The connection device includes preferably at least one connection socket, onto which the supply hose is pressed by means of a metal sleeve, and a connection element, in particular a rotatably supported union nut with a threaded connection or a bayonet closure. Such a configuration of the connection device has been proven successful in similar applications.

In order for a filling probe of a fill system to be inserted in the connection socket of the connection device of the supply hose in a simple and process safe manner, the connection socket preferably has on the side of supply an supply geometry which is favorable in terms of flow in particular an supply slant or an supply radius.

The preferably flexible supply hose can also be constructed to be pressure resistant against any pressure occurring during operation of the domestic appliance in that it is formed by an inner hose made of a flexible plastic and at least one fabric hose which tightly surrounds this inner hose. And the connection device of the preferably flexible supply hose can have a sealing ring which rests against the outer walling of the cylindrical connection socket.

BRIEF DESCRIPTION OF THE DRAWINGS

The invention and its advantageous developments are described in more detail below with reference to schematic drawings, in which.

DETAILED DESCRIPTION OF EXEMPLARY EMBODIMENTS OF THE PRESENT INVENTION

In the Figures, same or similar functioning or similar acting elements or components are provided with the same reference signs. Only the components of a water-bearing domestic appliance in particular the home dish washer or the home laundry machine are provide with reference signs which are necessary from understanding the invention. Of course, a water-bearing domestic appliance according to the invention can also have further components or component groups.

Figure 1:
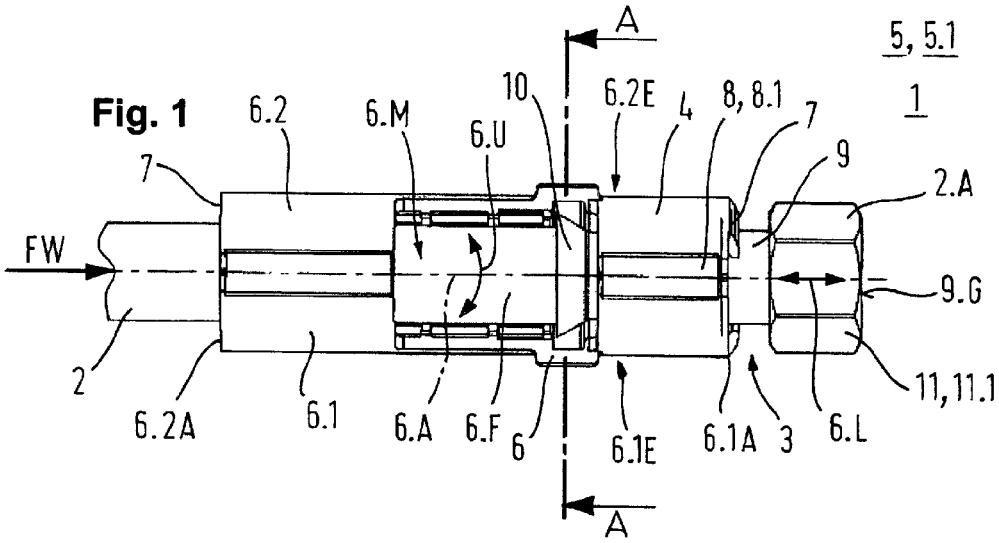
FIG. 1 shows a schematic front view of a preferred embodiment of a supply hose of a water-bearing domestic appliance according to the invention in a region of its connection device, wherein the supply hose at least in the region of its connection device is received at least in regions permanently and in particular at least in regions in a form fitting manner.

FIG. 1 shows a schematic front view of a horizontally oriented supply hose 2 of a water-bearing domestic appliance 1 in a region of its connection device 3, wherein the supply hose is received in regions permanently in the region of its connection device 3 at least in regions form fittingly.

A water-bearing domestic appliance 1 in particular a home dish washer or home laundry machine usually has a supply hose 2 for the supply of fresh water (FW (arrow) from a home water pipe HWL arranged outside of the water-bearing domestic appliance 1 into the water-bearing domestic appliance.

The supply hose 2 has in a manner known on its hose beginning 2.A a connection device 3 for the detachable connection with a home water line HWL. The supply hose is also usually guided into the interior of the water-bearing domestic appliance 1 through a wall 5, in particular a back wall 5.1 (cf. FIG. 7A to FIG. 7C).

Figure 7A:
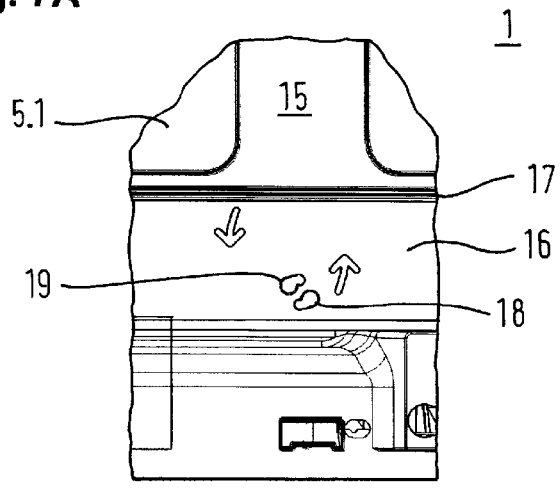
FIG. 7A to FIG. 7C shows a schematic sequence of installation of the supply hose shown in FIG. 1 of a water-bearing domestic appliance according to the invention.
Figure 7B:
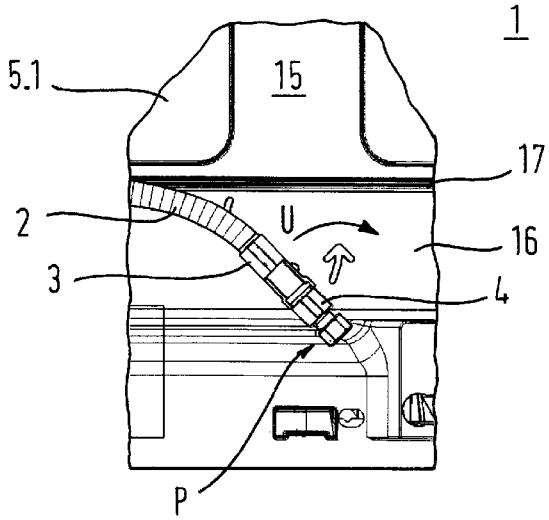
Figure 7C:
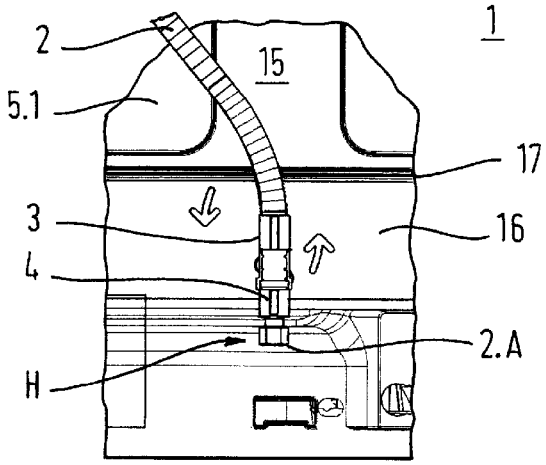

At least regions of the shown supply hose 2 of the water-bearing domestic appliance according to the invention are, at least in the region of its connection device 3 permanently received in a holding element 4 in particular at least in regions in a form fitting manner and the holding element 4 can be arranged on the wall 5 in particular the back wall 5.1 or the water-bearing domestic appliance 1 (cf. FIG. 7A to FIG. 7C).

The holding element 4 for a permanent and in particular form fitting reception of at least the connection device 3 includes a body unit 6 with an approximated cylindrical shape and a plurality of engagement units 7. The engagement units 7 are arranged on both axial ends of the body unit 6 and protrude from one side of the center axis 6.A of the body unit 6, to receive at least the connection device 3 at least regions of the connection device in a form fitting manner (cf FIG. 5 and FIG. 6).

Figure 5:
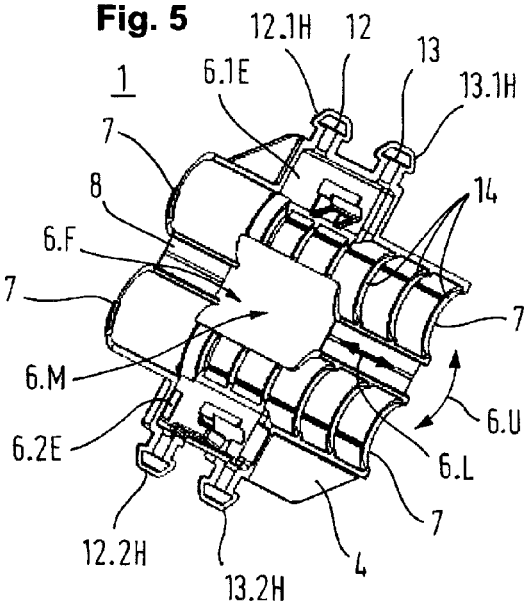
FIG. 5 shows a schematic inside view of the holding element for a supply hose shown in FIG. 1 of a water-bearing domestic appliance according to the invention.
Figure 6:
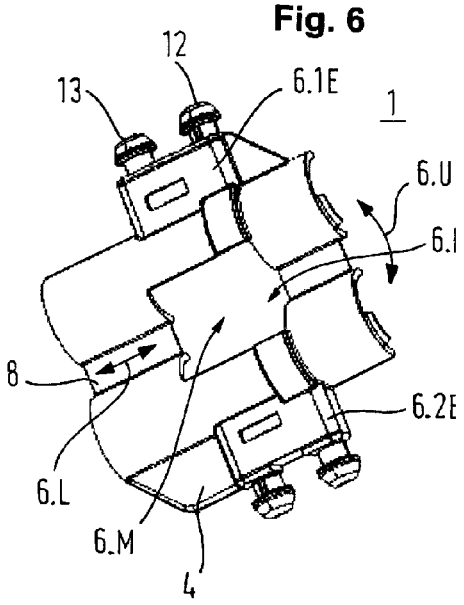
FIG. 6 a schematic outside view of the holding element for a supply hose shown in FIG. 1 of a water-bearing domestic appliance according to the invention.

The body unit 6 of the holding element 4 for the permanent and in particular form fitting reception of at least the connection device 3 is divided in two separate sections 6.1, 6.2, which are non-detachably interconnectable (cf. FIG. 5 and FIG. 6). The two separate sections 6.1, 6.2 further have a first engagement section 6.1E and a second engagement section 6.2E which are arranged separate from the two separated sections 6.1, 6.2 and are capable to be non-detachably brought into engagement with one another.

The body unit 6 of the holding element 4 for the permanent and in particular form fitting reception of at least the connection device 3, further has a joint unit 8, preferably a hinge 8.1, in particular a film hinge. The joint unit 8 arranged on side which is opposite the first engagement section 6.1E and the second engagement section 6.2E relative to the center axis of the body unit 6.

The body unit of the holding element 4 for the permanent and in particular form fitting reception of at least the connection device 3, also has a window section 6.F in a region 6.M which is centered in its longitudinal direction 6.L (double arrow), which window section which extends in a circumferential direction 6.0 (double arrow) of the body unit and which preferably interrupts and thereby divides the joint unit 8 in two.

The connection device 3 includes usually at least one connection socket 9, on which the supply hose 2 is pressed by means of a metal sleeve 10 and a connection element 11 in particular a rotatably supported union nut 11.1 with a threaded connection or a bayonet closure. The connection socket 9 of the connection device 3 of the supply hose 2 has also on the inlet side a flow-facilitating inlet geometry 9.G in particular an inlet slant or an inlet radius.

Figure 2:
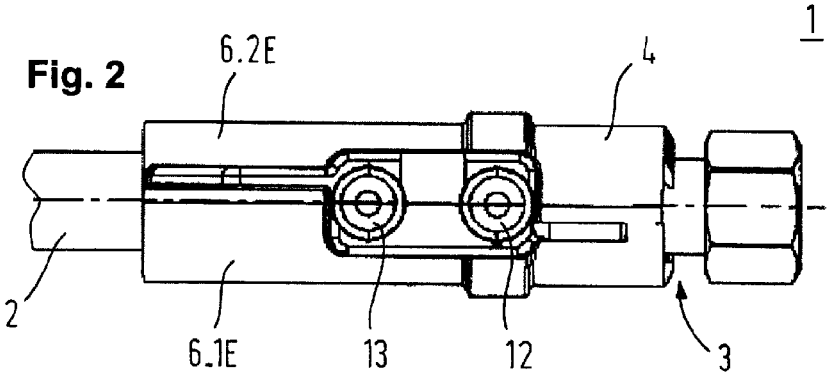
FIG. 2 shows a schematic rear view of the supply hose shown in FIG. 1 of a water-bearing domestic appliance according to the invention.

FIG. 2 shows a schematic rear view of the supply hose 2 of a water-bearing domestic appliance 1 shown in FIG. 1.

The shown supply hose 2 of the water-bearing domestic appliance 1 according to the invention is permanently received in a holding element 4, at least in the region of its connection device 3, and in particular at least in regions in a form fitting manner.

The holding element 4 for the permanent and in particular form fitting reception of at least the connection device 3, includes in the region of the two engagement sections 6.1E, 6.2E two mushroom-shaped and spaced apart holding pins 12, 13 (cf FIG. 3) which are connectable with the wall 5, in particular with the back wall 5.1 of the water-bearing domestic appliance 1 (cf. FIG. 7A to FIG. 7C).

Figure 3:
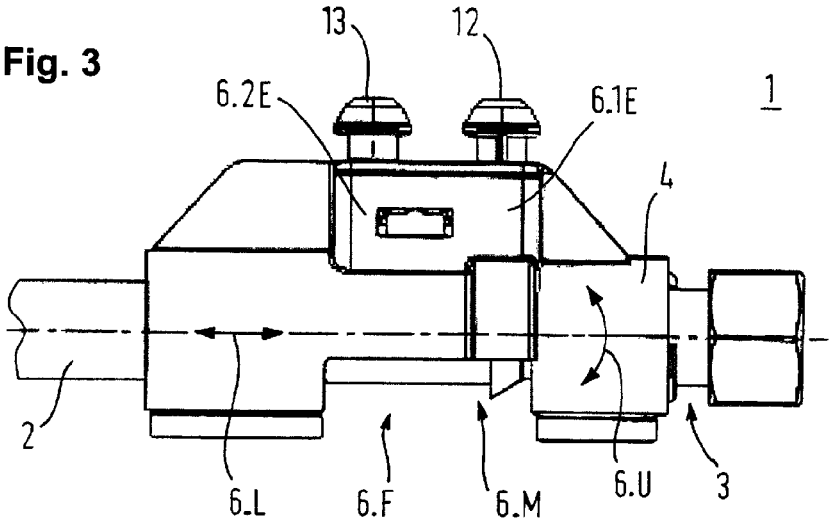
FIG. 3 shows a schematic side view of the supply hose shown in FIG. 1 of a water-bearing domestic appliance according to the invention.

FIG. 3 shows a schematic side view of the supply hose 2 of a water-bearing domestic appliance 1 shown in FIG. 1.

The shown supply hose 2 of the water-bearing domestic appliance 1 according to the invention is permanently and in particular, at least regions of the supply hose, form-fittingly received in a holding element 4, at least in the region of the connection device 3 of the supply hose 2.

The holding element 4 for the permanent and in particular form fitting reception of at least the connection device 3, includes in the region of the two engagement sections 6.1E, 6.2E two mushroom-shaped and spaced apart holding pins 12, 13 (cf. FIG. 3) which are connectable with the wall 5, in particular with the back wall 5.1 of the water-bearing domestic appliance 1 (cf. FIG. 7A to FIG. 7C).

The body unit 6 of the holding element 4 for the permanent and in particular form fitting reception of at least the connection device 3, further has a window section 6.F in a center region 6.M of its longitudinal direction 6.L (double arrow) which center region extends in a circumferential direction of the body unit 6 and interrupts and with this divides, the joint unit 8 into two portions.

Figure 4:
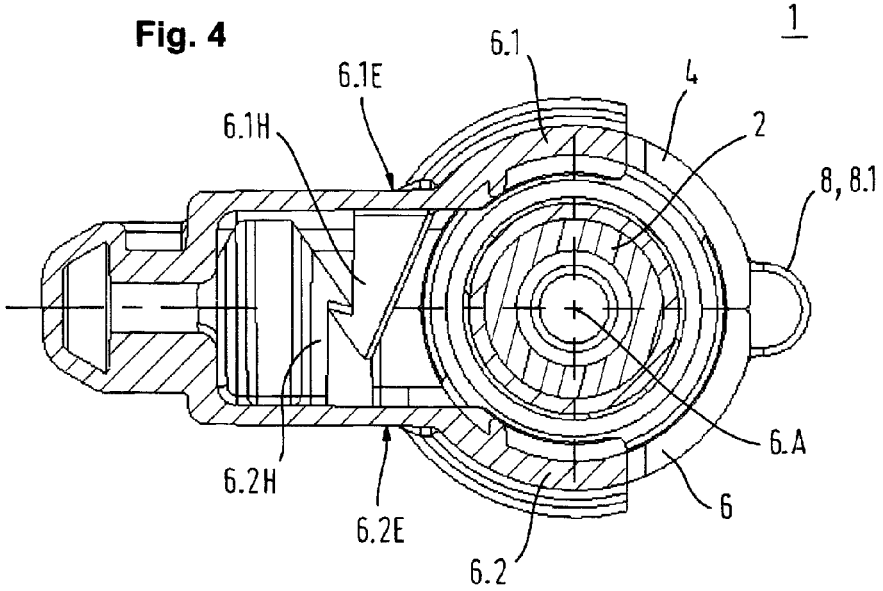
FIG. 4 shows a schematic sectional view of the supply hose shown in FIG. 1 of a water-bearing domestic appliance according to the invention.

FIG. 4 shows a schematic sectional representation of the supply hose 2 of a water-bearing domestic appliance 1, shown in FIG. 1 along the sectional line A-A.

The shown supply hose 2 is permanently and in particular, at least regions of the supply hose, form-fittingly received in a holding element 4, at least in the region of the connection device 3 of the supply hose 2. The holding element 4 in turn includes a body unit 6, which is divided into two separate sections 6.1, 6.2 which can be non-detachably interconnected. The two separated sections 6.1, 6.2 further have a first engagement section 6.1E and a second engagement section 6.2E which are arranged separate from the separate sections 6.1, 6.2 and can be non-detachably brought into engagement with one another. The body unit for the holding element 4 for the permanent and in particular form fitting reception of at least the connection device 3, further has a joint unit 8, preferably a hinge 8.1, in particular a film hinge. The joint unit 8 is arranged on a side which is opposite the first engagement section 6.1E and the second engagement section 6.2E relative to the center axis 6.A of the body unit 6.

The two engagement sections 6.1E, 6.2E of the two separate sections 6.1, 6.2 of the body unit 6 are configured as complementary engagement hooks 6.1H, 6.2H.

FIG. 5 shows a schematic inside view of the holding element 4 for a not shown supply hose of a water-bearing domestic appliance 1 shown in FIG. 1.

The holding element 4 for the permanent and in particular form fitting reception of at least the connection device of the not shown supply hose includes as previously mentioned in the region of the two engagement sections 6.1E, 6.2E two mushroom-shaped spaced apart holding pins 12, 13 (cf. FIG. 3). The single mushroom-shaped holding pin 12, 13 of the holding element 4 is divided identically longitudinally and one respective longitudinal half 12.H, 12.2H, 13.1H, 13.2H of the single mushroom-shaped holding pin 12, 13 of the holding element 4 is assigned to one of the two engagement sections 6.1E, 6.2E of the body unit 6 of the holding element 4 in a materially bonding manner.

Further, the already described window section 6.F can be seen clearly. The window section is arranged in a center region in a longitudinal direction 6.L (double arrow) of the body unit 6, extends in a circumferential direction 6.U (double arrow) of the body unit 6 and interrupts or respectively divides the joint unit 8 in two.

In this schematic inside view it can be clearly seen that the body unit 6 of the holding element 4 for the permanent and in particular form fitting reception of at least the connection device 3, includes in a region neighboring the plurality of engagement units 7 inside multiple radial webs 14, which ensure a secure guiding at least of regions of the not shown supply hose.

FIG. 6 shows a schematic outside view of the holding element 4 for a not shown supply hose of a water-bearing domestic appliance 1 according to the invention shown in FIG. 1.

Also in this schematic outside view the two in the region of the two engagement sections 6.1E, 6.2E arranged mushroom-shaped and spaced apart holding pins 12, 13 can be seen clearly. The same is true for the window section 6.F which in a in her longitudinal direction 6.L (double arrow) center region 6.M of the body unit 6 is arranged, which extends in a circumferential direction 6.U (double arrow) of the body unit 6 and which interrupts and thus divides the joint unit 8 in two.

FIG. 7A to FIG. 7C show a schematic installation sequence of the supply hose 2 on a water-bearing domestic appliance 1 according to the invention shown in FIG. 1.

The water-bearing domestic appliance is configured as a home dish washer 1 which has a treatment container 15 for receiving dishes to be treated. The back wall 5.1 of the home dish washer 1 which back wall 5.1 receives the holding element for permanently and in particular form fittingly receiving at least the connection device 3 (cf. FIG. 1 to FIG. 6) is a basic carrier 16, in particular a plastic floor 16.1 which carries the treatment container 15 by means of an at least backside acting guiding arrangement 17.

For receiving the holding element 4 by means of the two mushroom-shaped and spaced apart holding pins 12, 13 (cf. FIG. 3) two open receiving contour 18, 19 are provided in the basic carrier 16, which are configured congruent to the two holding pins 12, 13. The two receiving contours 18, 19 are further oriented so that the holding element 4 which can be arranged on the back wall 5.1 of the home dish washer 1 is oriented in its holding position H so that it guides the supply hose 2 vertically or approximately vertically and so that the beginning of the hose 2.A of the supply hose 2 is oriented downward (cf. FIG. 3).

FIG. 7A shows a partial view of the back wall 5.1 of the treatment container 15 and the basic carrier 16 of the home dish washer 1. It can be clearly seen that in the basic carrier 16 the two open receiving contours 18, 19 provided, which are configured congruent to the two holding pins 12, 13 for receiving (cf. FIG. 3).

In the representation of FIG. 7B the holding element 4 which has the two mushroom-shaped and spaced apart holding pins 12, 13 (cf. FIG. 3) is then arranged in an insertion position E in the two open receiving contours 18,19 (cf. FIG. 7A). The supply hose 2 is at least in the region of its connection device 3 permanently and in particular at least in regions form fittingly received.

The holding element 4 which is arranged in the two receiving contours 18, 19 by means of the two mushroom-shaped holding pins 12, 13 (cf. FIG. 3) is then rotated in clockwise direction U (arrow). This rotation is limited by the shape of the two receiving contours 18, 19.

FIG. 7C shows the receiving element 4 in the holding position which is rotated up to the limitation. In this holding position H, the supply hose 2 is guided approximately vertically and the beginning 2.A of the supply hose 2 is oriented downward.

The shown holding position H creates ideal conditions for an automated and at the same time function testing initial filling of the water-bearing domestic appliance 1 via the supply hose 2, because a filling probe of a filling system can approach the connection device 3 of the supply hose 1 of the water-bearing domestic appliance 1 from below in an automated manner.

In summary, the invention refines a water-bearing domestic appliance in particular a home dish washer or a home laundry machine according to the preamble of the independent claim such that on one hand the possibly occurring and described device inherent installation problem is effectively prevented, preferably its occurring is completely excluded, on the other hand the positioning of the connection device of the supply hose is at least during the installation of the water-bearing is ensured in an accurate and reproducible manner for possible testing purposes.

What is claimed is:

1. A water-bearing domestic appliance, comprising:

a wall at least partly defining an interior of the water-bearing domestic appliance;

a supply hose configured to supply fresh water from a domestic water pipe into the water-bearing domestic appliance, said supply hose being guided through the wall of the water-bearing domestic appliance into the interior of the water-bearing domestic appliance;

a connection device provided to a beginning of the supply hose and configured to detachably connect with the domestic water pipe; and at least one holding element structure to permanently receive the supply hose and the connection device, wherein the holding element comprises a body unit that is divided into two non-detachably inter-connectable separate sections, one of the two separate sections having a first engagement section and the other of the two separate sections having a second engagement section, and wherein the holding element comprises at least one holding pin structured to detachably connect the holding element to the wall of the domestic appliance, the at least one holding pin having a first half formed on the first engagement section and a second half formed on the second engagement sections.

2. The water-bearing domestic appliance of claim 1, wherein the water-bearing domestic appliance is a domestic dish washer or a domestic washing machine.

3. The water-bearing domestic appliance of claim 1, wherein at least a region of the supply hose is form fittingly received in the at least one holding element.

4. The water-bearing domestic appliance of claim 1, wherein the wall is a back wall of the water-bearing domestic appliance.

5. The water-bearing domestic appliance of claim 1, wherein said body unit being of a substantially cylindrical shape and having a plurality of engagement units, said engagement units being arranged on at least one axial end of the body unit and protruding to one side of a center axis of the body unit to thereby form-fittingly receive at least regions of at least the connection device.

6. The water-bearing domestic appliance of claim 5, wherein respective sides of the first engagement section and the second engagement section oppose one another along the center axis of the body unit, and wherein the body unit comprises a joint unit arranged on the respective sides.

7. The water-bearing domestic appliance of claim 6, wherein the joint unit is constructed as a hinge.

8. The water-bearing domestic appliance of claim 7, wherein the hinge is a film hinge.

9. The water-bearing domestic appliance of claim 1, wherein the first and second engagement sections are configured as complementary engagement hooks.

10. The water-bearing domestic appliance of claim 6, wherein the body unit has a window section in a center region of the body unit in relation to a longitudinal direction of the body unit, said window section extending in a circumferential direction of the body unit and interrupting the joint unit, thereby dividing the joint unit into two portions.

11. The water-bearing domestic appliance of claim 10, wherein the joint unit is constructed as a hinge.

12. The water-bearing domestic appliance of claim 10, wherein the joint unit is constructed as a film hinge.

13. The water-bearing domestic appliance of claim 5, wherein an inside of the body unit is provided with multiple radial webs in a region neighboring the plural engagement units, said radial webs being constructed to securely guide at least some regions of the supply hose.

14. The water-bearing domestic appliance of claim 1, wherein the at least one holding pin comprises two mushroom-shaped, spaced apart holding pins, said mushroom-shaped, spaced apart holding pins being detachably connectable with the wall of the water-bearing domestic appliance.

15. The water-bearing domestic appliance of claim 14, wherein the wall is a back wall of the water-bearing domestic appliance.

16. The water-bearing domestic appliance of claim 1, wherein the first half and the second half are identical.

17. The water-bearing domestic appliance of claim 1, wherein the first half and the second half are materially connected to the first engagement section and the second engagement section, respectively.

18. The water-bearing domestic appliance of claim 15, constructed in the form of a domestic dish washer and comprising a treatment container for receiving wash ware, wherein the back wall is constructed in the form of a basic carrier.

19. The water-bearing domestic appliance of claim 18, further comprising a guiding arrangement acting at least on a back side of the water-bearing domestic appliance, wherein the basic carrier is constructed in the form of a plastic floor and carries the treatment container by means of the guiding arrangement.

20. The water-bearing domestic appliance of claim 4, wherein the holding element is positioned in a holding position and is oriented so that it guides the supply hose vertically or approximately vertically, and wherein the beginning of the supply hose is oriented downward.

21. The water-bearing domestic appliance of claim 4, further comprising a metal sleeve and a connection element, wherein the connection device includes at least one connection socket, said supply hose being pressed onto the connection socket by means of the metal sleeve and the connection element.

22. The water-bearing domestic appliance of claim 21, wherein the connection element is constructed as one of a rotatably supported union nut with a threaded connection and a bayonet closure.

23. The water-bearing domestic appliance of claim 21, wherein the connection socket has a flow-facilitating inlet geometry arranged on an inlet side.

24. The water-bearing domestic appliance of claim 23, wherein the inlet geometry is constructed as a slant or an inlet radius.

* * * * *